United States Patent [19]

King

[11] 4,397,597

[45] Aug. 9, 1983

[54] METHOD FOR THREADING CLOSURES

[75] Inventor: Roderick V. King, Girard, Pa.

[73] Assignee: Ethyl Products Company, Richmond, Va.

[21] Appl. No.: 200,909

[22] Filed: Oct. 27, 1980

[51] Int. Cl.[3] ..... B21D 39/03

[52] U.S. Cl. ..... 413/23; 72/103; 413/46

[58] Field of Search ..... 413/23, 56, 1, 46; 72/103, 112, 113, 114, 115; 220/288

[56] References Cited

U.S. PATENT DOCUMENTS

| | | | |
|---|---|---|---|
| 1,900,880 | 3/1933 | Kramer | 72/103 X |
| 2,019,493 | 11/1935 | Hothersall | 72/103 X |
| 2,215,845 | 9/1940 | Williams | 72/103 X |
| 2,348,085 | 5/1944 | Merolle | 153/72 |
| 2,348,085 | 5/1944 | Merolle | 72/103 X |
| 2,353,349 | 7/1944 | Merolle | 72/103 X |
| 2,957,439 | 10/1960 | Stuchberry | 413/46 |
| 3,311,077 | 3/1967 | Andrew et al. | 113/1 |

*Primary Examiner*—Leon Gilden

*Attorney, Agent, or Firm*—Donald L. Johnson; John F. Sieberth

[57] ABSTRACT

A method and apparatus for threading a closure which includes securing the closure in a stationary nest, inserting a threading tool having threads on the outside thereof into the interior of the closure, moving the threading tool into contact with the interior portion of the closure upon which threads are to be formed, and moving the threading tool around the interior portion of the stationary closure in an orbital path to form threads in the closure without rotating the threading tool about the threading tool axis.

9 Claims, 9 Drawing Figures

METHOD FOR THREADING CLOSURES

BACKGROUND OF THE INVENTION

The present invention is related to threading closures and, more particularly, to threading metal closures. Such closures include metal caps which are commonly used on a variety of bottles and jars such as medicine bottles, cosmetic containers, and the like. The common metal cap consists of a metal shell having a cylindrical wall, the edge of which is turned inwardly and threaded. The screw threads are formed on the inwardly turned edge.

Various methods are known for threading caps. One of the first methods of threading metal caps utilized two expanding tools in series. The first tool formed segments of threads leaving intervening unthreaded areas, and the second tool completed the thread.

Another method of threading caps is shown in U.S. Pat. No. 2,209,416 issued to Montelione. In this method a rotating chuck was utilized to hold a cap, and a threading tool smaller than the cap was inserted into the cap. After inserting the threading tool into the cap, the tool was moved toward the wall of the cap to form the thread by impressing a pre-threaded portion on the threading tool into the edge of the cap which had previously been turned inwardly. The threading tool would rotate in the same direction as the cap rotated. Furthermore, the threading tool rotates at the same speed as the cap. Such threading equipment necessitates removal of the cap from the cap-forming apparatus and movement to the threading station where the cap must be rotated during the threading operation.

The Invention

In accordance with the present invention there is provided a method and apparatus for threading a closure which includes securing the closure in a stationary nest, inserting a threading tool having threads on the outside thereof into the interior of the closure, moving the threading tool into contact with the interior portion of the closure upon which threads are to be formed, and moving the threading tool around the interior portion of the stationary closure in an orbital path to form threads in the closure without rotating the threading tool about the threading tool axis.

An advantage of the invention is that several excess operations are eliminated by performing the threading operations while the cap is still in the machine which curls the inside edge of the cap. Another advantage is that scratches and dents of caps would be reduced by eliminating conveyors, transfers of the cap from one station to another, and insertion in rotating chucks. Furthermore, floor space and equipment, synchronization and control problems are also reduced. Also, tooling may be quickly changed to thread different sizes of caps.

DESCRIPTION OF THE PREFERRED EMBODIMENTS

Figure 1:
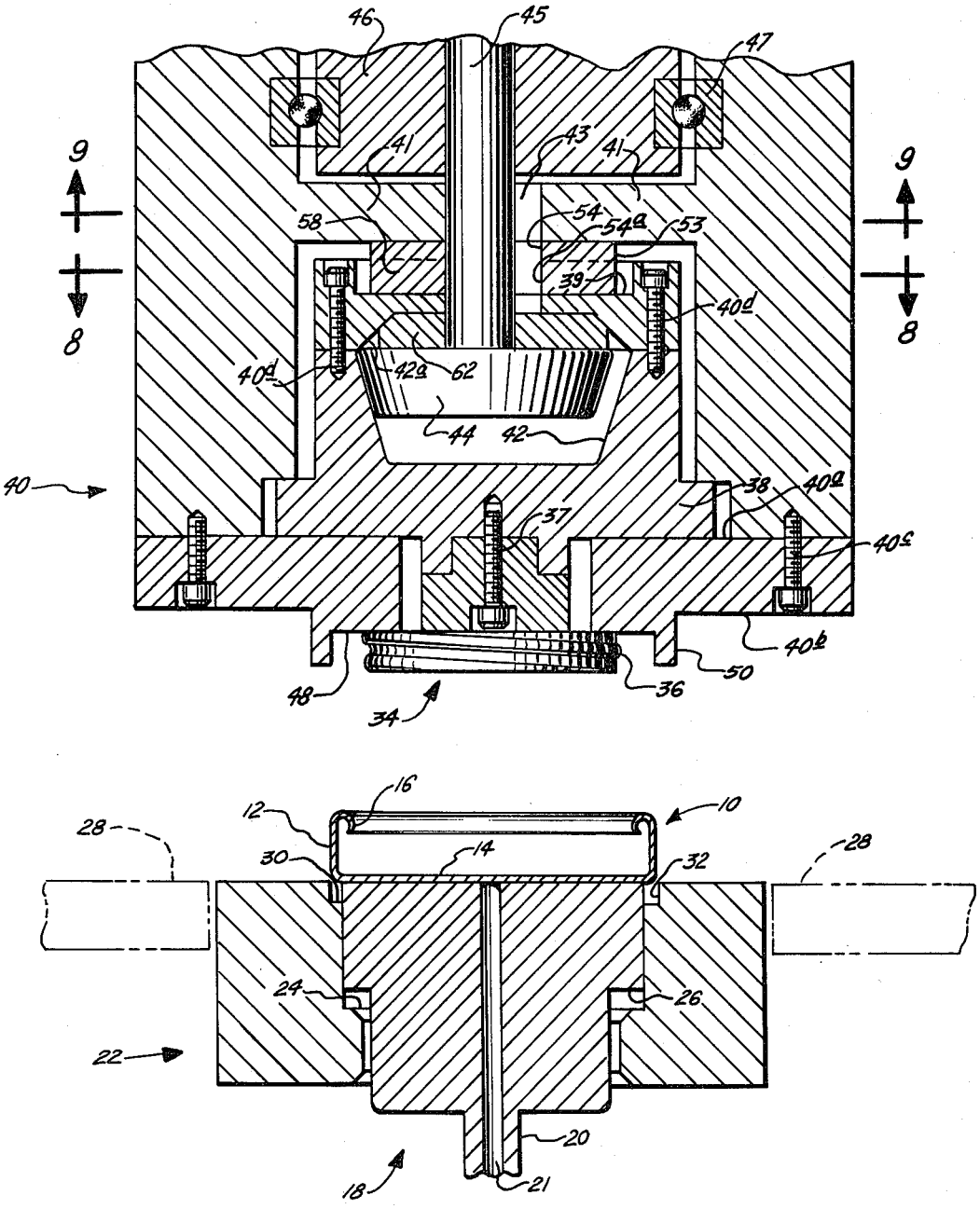
FIG. 1 is a partly cut-away, partly cross-sectional, elevational view of the threading apparatus of the present invention showing an unthreaded cap axially aligned with the threading tool.

Referring now to the drawings, in FIG. 1 is shown a closure or cap generally indicated by the numeral 10 which has a side wall 12, a top 14, and an inwardly turned curled edge 16 into which threads are to be formed. The closures or caps 10 to which the invention has greatest utility are made from metal. Plastic closures or caps may also be used if desired.

The cap in FIG. 1 is supported by a cap support member 18 to which is attached rod 20 for movement of cap support member 18 upwardly and downwardly. Surrounding cap support 18 is the cap nest generally indicated by the numeral 22.

A channel 21 may be formed in member 18 and a vacuum applied thereto to hold cap 10 on member 18. Also, when the cap is formed from a metal which is attracted to a magnet, member 18 may be magnetized to hold cap 10 thereon.

Cap nest 22 has an interior circular shoulder 24 which limits the downward movement of cap support member 18 when the shoulder 24 strikes the circular shoulder 26 of cap support member 18. Cap nest 22 is supported by cap nest support members 28. Cap nest 22 also has a second upper circular shoulder 30 upon which the edge of cap 10 rests during the threading operation. Adjacent to shoulder 30 in cap nest 22 is sidewall 32 which contacts the sidewall 12 of cap 10 during the threading operations to prevent horizontal movement of the cap.

In FIG. 1 the threading tool generally indicated by the numeral 34 is shown immediately above and axially aligned with cap 10, cap support member 18, and cap nest 22. Threading tool 34 has a series of threads 36 located thereon. Threading tool 34 is rigidly connected by bolt 37 to the threading tool carrier generally indicated by the numeral 38. Threading tool carrier 38 is in turn located in the threading tool carrier housing generally indicated by the numeral 40.

Figure 2:
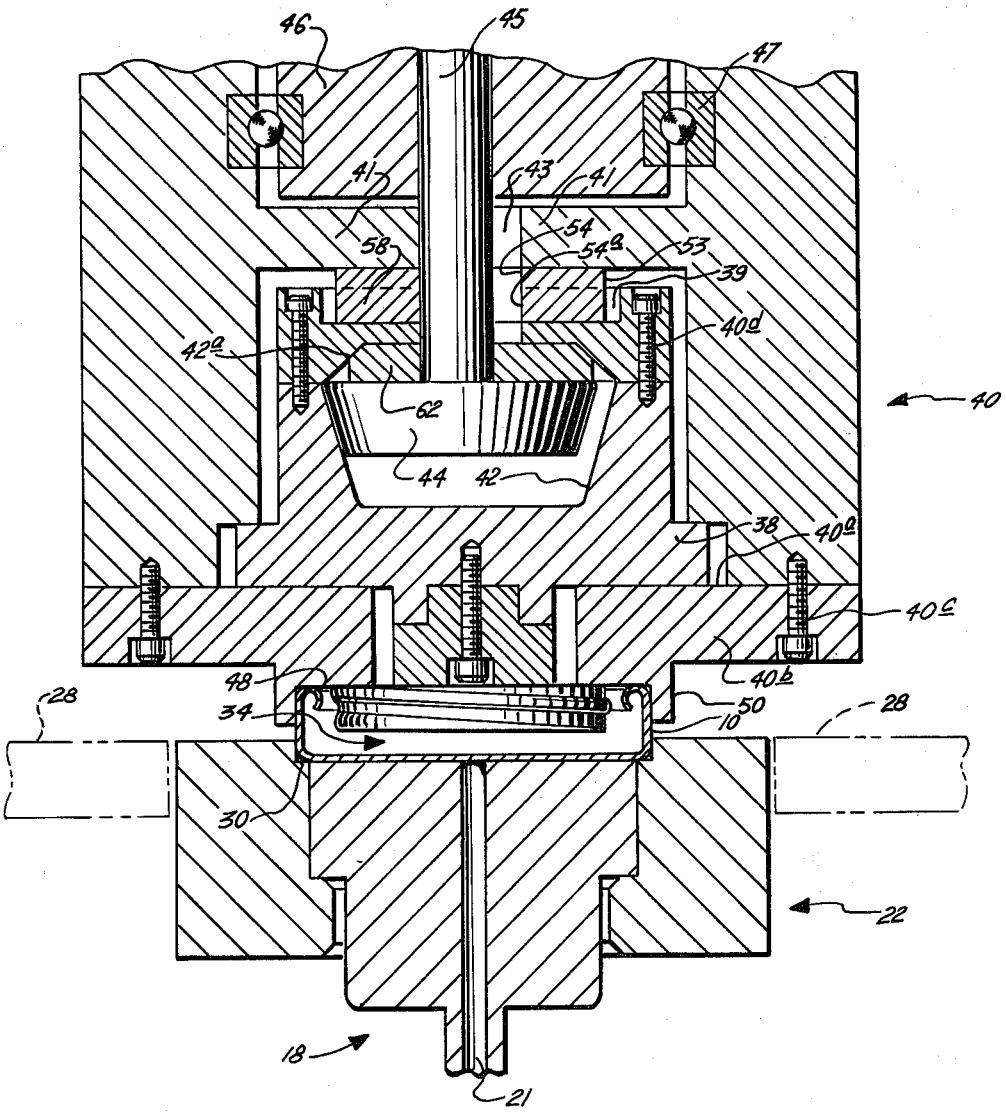
FIG. 2 is a partly cut-away, partly cross-sectional, elevational view of the threading tool axially aligned with the unthreaded cap and with the threading tool inserted into the interior of the cap.
Figure 3:
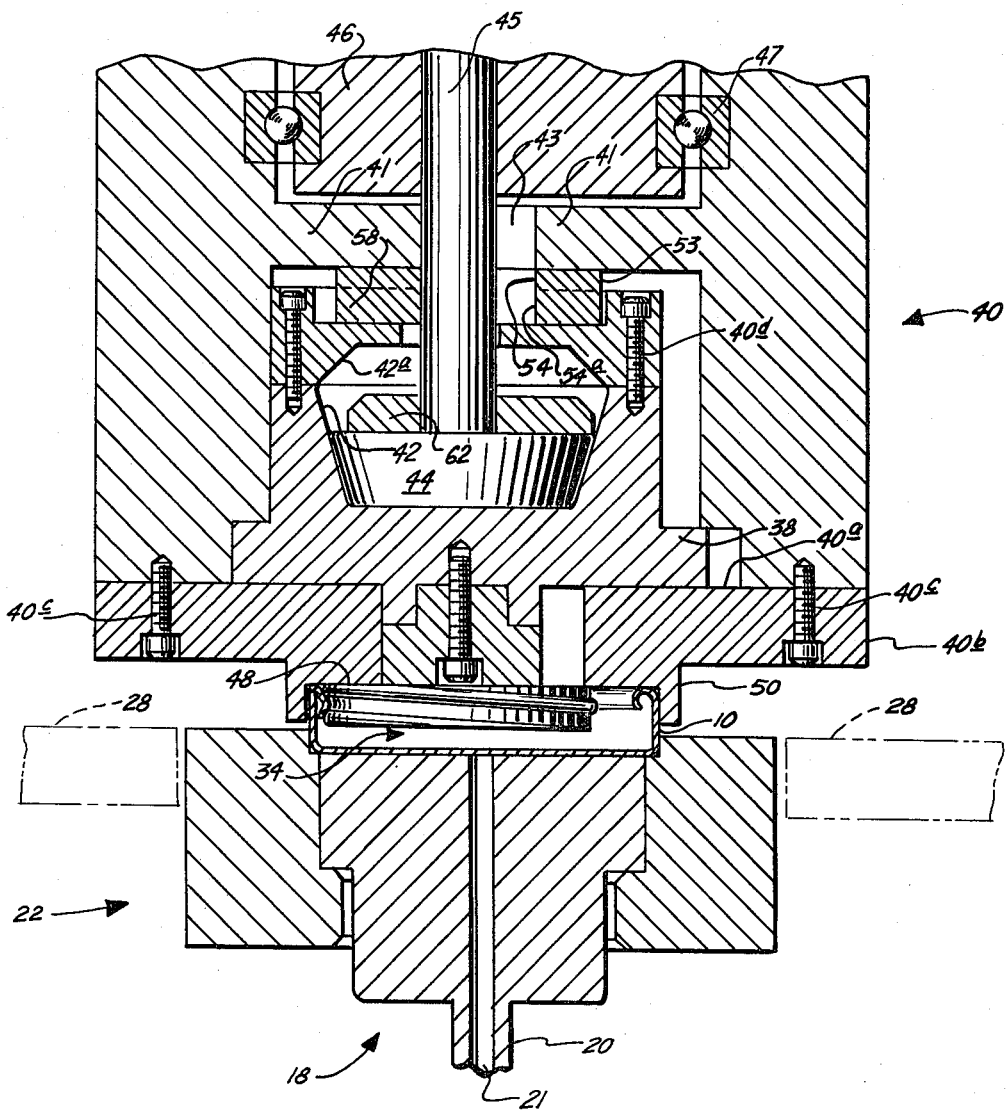
FIG. 3 is a partly cut-away, partly cross-sectional, elevational view of the threading tool inserted into the cap and making initial contact with the curled portion of the interior wall of the cap.

Threading tool carrier 38 can be seen in FIGS. 1-3 to have a conical recess generally indicated by the numeral 42 in the top thereof. Conical recess 42 is axially aligned with threading tool 34.

Located in conical recess 42 is actuating cone 44 which is rigidly connected to eccentric shaft 45 which is in turn slidably connected to rotating sleeve 46. Rotating sleeve 46 rotates in ball bearing 47 which is contained in threading tool carrier housing 40. Cone 44 may be rotatably connected to shaft 45.

Referring now to FIG. 2, the threading tool 34 is shown inserted into the interior of cap 10. The insertion of threading tool 34 into cap 10 is accomplished by moving threading tool carrier housing 40 downwardly until the bottom shoulder 48 contacts cap 10 and forces cap 10 downwardly into cap nest 22 so that the bottom 14 of cap 10 strikes shoulder 30 in cap nest 22. Thus, the downward force of surface 48 on cap 10 prevents rotation of cap 10. A cap locating ring 50 at the bottom of housing 40 slips snuggly about the outside of cap 10 to hold and align the cap securely within threading tool carrier 40.

Referring now to FIG. 3, eccentric shaft 45 is seen to be extended downwardly from the position shown in FIG. 2. Eccentric shaft 45 slides downwardly within rotating sleeve 46. The downward movement of shaft 45 forces actuating cone 44 into the bottom of conical recess 42 and thereby slides conical recess 42 laterally or horizontally, thus forcing threads 36 of threading tool 34 into contact with the inwardly curled edge 16 of cap 10 making a thread impression therein. After insertion of the threading tool 34 into cap 10, sleeve 46 is rotated 360° to thread the cap and rotation is stopped. During the 360° rotation of sleeve 46, the threading tool carrier 38 is forced about in an orbital motion thus bringing threading tool 34 into contact with all of inwardly curled edge 16 of cap 10 to form threads entirely around the interior of cap 10. Preferably, the threading operation is begun at the same position as shown in FIG. 3 each time a cap is threaded. Such orientation of the threading tool permits two threads on the threading tool to contact the curled edge simultaneously, as shown in FIG. 3.

Figure 4:
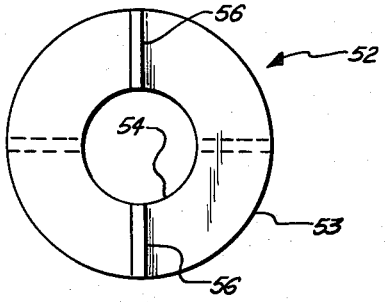
FIG. 4 is a top view of a restraining plate.
Figure 6:
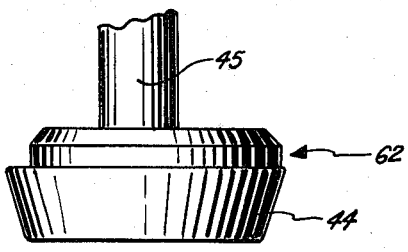
FIG. 6 is a partly cut-away side view of an actuating cone and centering disc.
Figure 5:
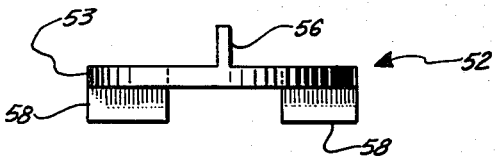
FIG. 5 is a side view of the plate of FIG. 4.
Figure 7:
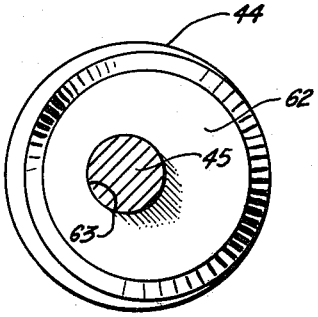
FIG. 7 is a top, partly sectional view of the actuating cone and centering disc of FIG. 6.

It is preferred that threading tool carrier 38 and threading tool 34 do not rotate about their vertical axes. Any conventional means may be used to prevent rotation. In the embodiment shown in the drawings a plate generally indicated by the numeral 52 and shown in detail in FIGS. 4 and 5, is utilized to prevent rotation of threading tool carrier 38 and threading tool 34.

Plate 52 includes a flat disc 53 having a hole 54 in the center thereof for receipt of eccentric shaft 45. Hole 54 must be sufficiently large enough in diameter to permit shaft 45 to orbit therein. Two guides 56—56 and 58—58 are aligned on the top and bottom of disc 53, the two top guides being aligned at a right (90°) angle to the bottom guides.

Figure 8:
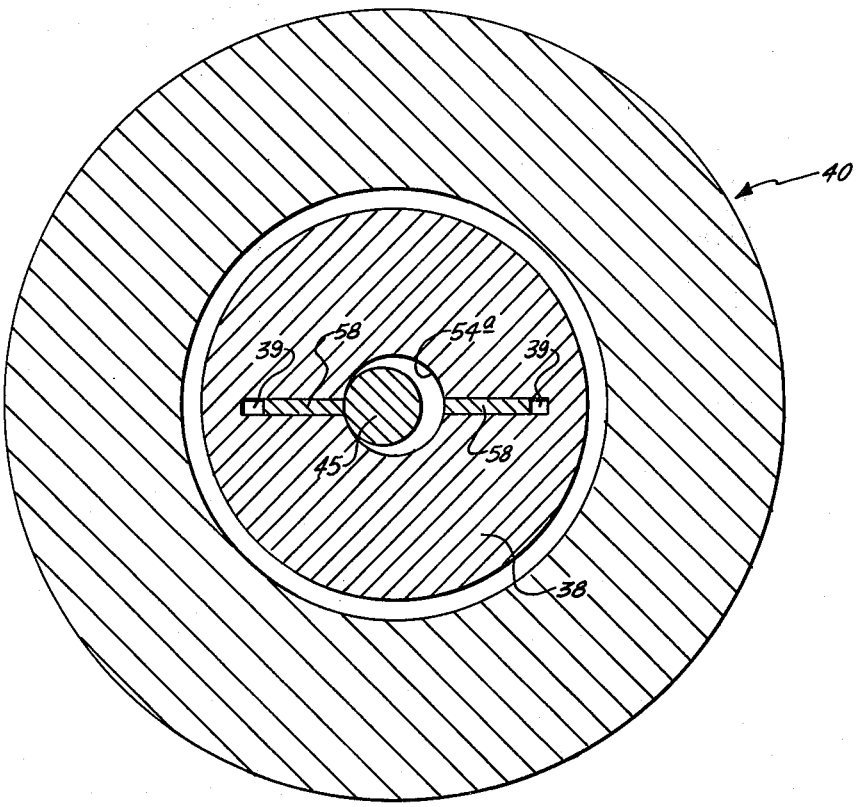
FIG. 8 is a cross-sectional view taken along lines 8—8 of FIG. 1.
Figure 9:
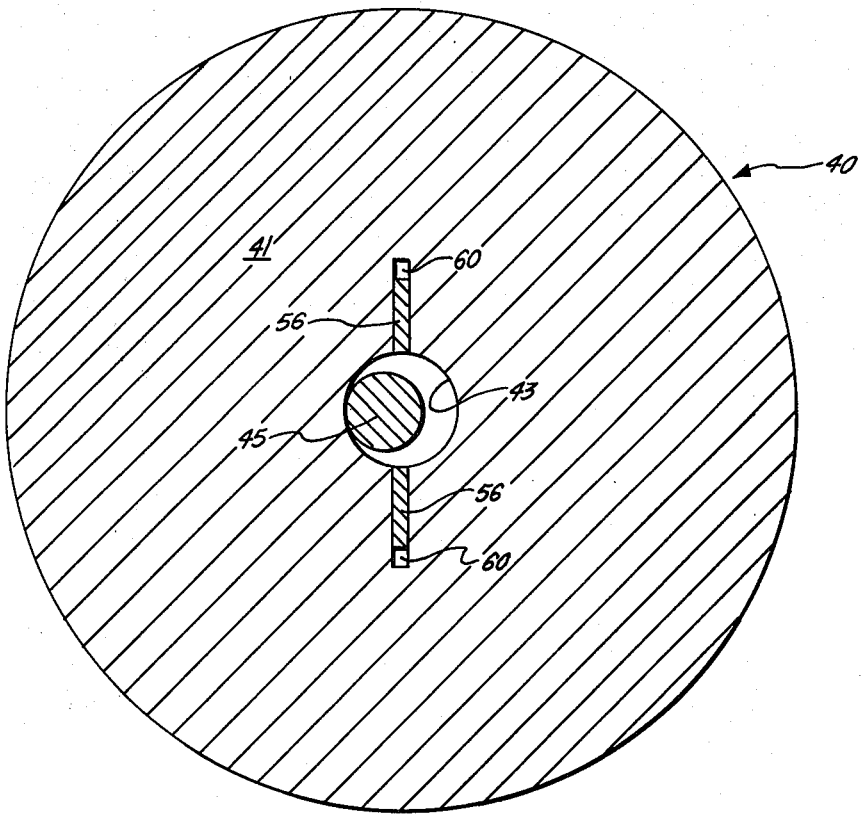
FIG. 9 is a cross-sectional view taken along lines 9—9 of FIG. 1.

As can best be seen in FIG. 8, threading tool carrier 38 has a slot 39 in the top thereof for sliding receipt of guides 58—58 and a hole **54*a* therein for receipt of shaft 45. As can be seen in FIGS. 1–3 and FIG. 9, threading tool housing 40 has a horizontal disc portion 41 located above plate 52 which has a hole 43 therein for receipt of shaft 45. Hole 43 must be sufficiently large enough for shaft 45 to orbit therein, and preferably, has the same diameter as hole 54 in plate 52. Slot 60 is formed in the bottom of horizontal disc portion 41 for sliding receipt of guides 56—56 of plate 52. Thus, rotation of threading tool carrier 38 and threading tool 34** is prevented.

Threading tool carrier 38 slides about the interior of threading tool carrier housing 40 in an orbital motion. Threading tool carrier 38 has a flat lower surface which slides upon flat interior surface **40*a* of threading tool carrier housing 40**.

A centering disc, generally indicated by the numeral 62 shown in FIGS. 1–3, 6, and 7, is located at the top of actuating cone 44 to center threading tool carrier 38 in the center of housing 50 when actuating cone 44 is moved to its uppermost position as shown in FIGS. 1 and 2. Centering disc 62 has a hole 63 in the top thereof for receipt of shaft 45. The upper edge 65 is beveled to nest against the beveled upper edge **42*a* of recess 42. Centering disc 62 is rigidly connected to cone 44 in the position shown in FIGS. 6 and 7 such that no portion of disc 62 extends outwardly past the outermost edge of cone 44**.

After the entire cap is threaded, rotating sleeve 46 is stopped and eccentric shaft 45 is withdrawn to the upper position shown in FIG. 1. Threading tool carrier housing 40 is then moved upwardly to remove threading tool 34 from the interior of cap 10. Cap 10 now has threads therein and the threading operation is complete. Cap support member 18 then returns the bottom of cap 10 to the level of the top of cap nest 22.

An advantage of the invention is that different size caps can be threaded by quickly changing the threading tool 34, nest 22, and the lower portion **40*b* of threading tool housing 40 by removing bolts 40*c* and 37. If the depth of the threads varies sufficiently, threading tool carrier 38 and actuating cone 44 can be replaced. Threading tool carrier 38 may be separated to gain access to actuating cone 44 by extending shaft 45 downwardly and removing bolts 40*d***.

Although the preferred embodiments of the present invention have been disclosed and described in detail above, it should be understood that the invention is in no sense limited thereby and its scope is to be determined by that of the following claims.

What is claimed:

1. A method of forming a spiral thread in the inturned curled edge provided at the lower end of the sidewall of a closure comprising:

a. vertically lowering the closure until its shoulder makes contact with a shoulder provided on a cap nest carried by a fixed support member;

b. vertically lowering a threading tool having at least one spiral thread on its exterior into the interior of the closure;

c. supporting the upper portion of the sidewall of the closure with a fixed support member separate from the cap nest;

d. transversely moving the threading tool so that the spiral thread contacts the inturned curled edge on the closure;

e. moving the threading tool around the curled edge of the closure in an orbital path while restraining the threading tool against both rotational and longitudinal movement to form at least one spiral thread in the curled edge of the closure.

2. The method of claim 1 wherein the orbital path of the threading tool is produced by driving the threading tool with an eccentrically mounted drive shaft.

3. The method of claim 2 wherein the transverse movement of the threading tool is produced by moving downwardly an actuating cone carried on the lower end of the drive shaft and contacting the upwardly tapered, upwardly facing, axially aligned walls of an annular recess in the interior of the threading tool.

4. The method of claim 3 wherein the threading tool is returned to axial alignment with the closure after the thread forming step by moving upwardly a centering disk carried by the drive shaft and contacting the downwardly tapered walls of a downwardly facing axially aligned annular recess in the interior of the threading tool.

5. The method of claim 1 wherein, after step "d", the threading tool is first moved transversely away from contact with the curled edge of the closure and then is moved vertically upward out of the closure.

6. The method of claim 1 wherein the closure is a metal closure.

7. The method of claim 1 wherein the orbital path is a circle having as its center the centerline of said closure.

8. The method of claim 1 wherein the vertical axis of the threading tool follows the orbital path while forming threads in the closure.

9. The method of claim 1 wherein a predetermined location on the threading tool makes initial contact with the interior of each of the closures threaded.

* * * * *

UNITED STATES PATENT AND TRADEMARK OFFICE

CERTIFICATE OF CORRECTION

PATENT NO. : 4,397,597

DATED : AUGUST 9, 1983

INVENTOR(S) : RODERICK V. KING

It is certified that error appears in the above—identified patent and that said Letters Patent is hereby corrected as shown below:

Column 4, line 63, reads "step d", and should read -- step e --.

Signed and Sealed this

*Fifteenth* Day of *November 1983*

[SEAL]

*Attest:*

GERALD J. MOSSINGHOFF

*Attesting Officer*

*Commissioner of Patents and Trademarks*